US011401123B2

(12) United States Patent
Kinoshita et al.

(10) Patent No.: US 11,401,123 B2
(45) Date of Patent: Aug. 2, 2022

(54) PRINT DEVICE AND METHOD OF CONTROLLING PRINT DEVICE

(71) Applicant: SEIKO EPSON CORPORATION, Tokyo (JP)

(72) Inventors: Yoshiaki Kinoshita, Matsumoto (JP); Azusa Kitahara, Tomi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 458 days.

(21) Appl. No.: 16/260,979

(22) Filed: Jan. 29, 2019

(65) Prior Publication Data

US 2019/0233232 A1 Aug. 1, 2019

(30) Foreign Application Priority Data

Jan. 30, 2018 (JP) ..... JP2018-013953

(51) Int. Cl.

| | |
|---|---|
| ***B65H 5/06*** | (2006.01) |
| ***B65H 9/10*** | (2006.01) |
| ***B41J 13/10*** | (2006.01) |
| ***B65H 7/08*** | (2006.01) |
| ***B41J 11/48*** | (2006.01) |
| ***B41J 11/00*** | (2006.01) |

(52) U.S. Cl.

CPC ..... *B65H 5/068* (2013.01); *B41J 11/0095* (2013.01); *B41J 11/48* (2013.01); *B41J 13/103* (2013.01); *B65H 7/08* (2013.01); *B65H 9/106* (2013.01)

(58) Field of Classification Search

CPC ..... B41J 11/0095; B41J 11/48; B41J 11/003; B41J 13/0054; B65H 2511/11; B65H 2301/3411

See application file for complete search history.

(56) References Cited

U.S. PATENT DOCUMENTS

| | | | | |
|---|---|---|---|---|
| 6,102,595 | A | 8/2000 | Satoh et al. | |
| 2001/0021331 | A1* | 9/2001 | Brewington | B41J 3/60 400/188 |
| 2011/0290617 | A1* | 12/2011 | Kwak | G06Q 20/042 194/334 |
| 2012/0224202 | A1* | 9/2012 | Ito | B41J 13/0054 358/1.12 |

FOREIGN PATENT DOCUMENTS

| | | | |
|---|---|---|---|
| JP | S6094374 | A | 5/1985 |
| JP | 2002-316747 | A | 10/2002 |

* cited by examiner

*Primary Examiner* — Jennifer Bahls
*Assistant Examiner* — Quang X Nguyen
(74) *Attorney, Agent, or Firm* — Chip Law Group

(57) ABSTRACT

A print device includes: a first opening via which a print medium is to be inserted or ejected; a second opening via which the print medium is to be ejected; a transport roller that transports the print medium; a housing that contains a transport route; a first sensor that detects presence of the print medium; and a second sensor that detects the presence of the print medium on an upstream side of the first sensor; and a processor. When a command designates the print medium to be ejected to the outside via the second opening and a length of the print medium determined from the detection states of the first and the second sensors is shorter than or equal to a predetermined length, the processor ejects the print medium to the outside via the first opening.

7 Claims, 10 Drawing Sheets

PRINT DEVICE AND METHOD OF CONTROLLING PRINT DEVICE

CROSS REFERENCE TO RELATED APPLICATIONS

The present invention claims priority to Japanese Application No. 2018-013953 filed on Jan. 30, 2018 which are hereby incorporated by reference in their entirety.

BACKGROUND

1. Technical Field

The present invention relates to a print device and a method of controlling the print device.

2. Related Art

Some known print devices have a mechanism for correcting an inclined position of a print medium such as a print sheet. For example, a printer disclosed in JP-A-2002-316747 includes a sheet supply unit that corrects an inclined position of a print sheet. This printer further includes: a roller; a supply sensor that detects the presence of the print sheet; a controller that controls the transport of the print sheet; a sheet transport surface; and a supply shaft provided above the sheet transport surface. Further, the sheet transport surface has a plurality of recesses, and the supply shaft has a plurality of projections arranged along the width of the print sheet. The projections and the recesses are positioned in relation to each other. When the supply sensor detects the presence of the print sheet, the controller transports the print sheet by an amount according to the number of operation steps of the roller. Then, the supply shaft presses the print sheet against the sheet transport surface with the projections inserted into the recesses. In this way, the inclined position of the print sheet is corrected.

An inclined position of a print medium in a print device may affect detection of a length of the print medium and control of the transport amount. As a result, for example, the print device might fail to transport the print medium by a sufficient amount so that the print medium is not ejected to the outside. This disadvantage can be overcome by a mechanism for correcting an inclined position of a print medium as provided in the above-disclosed printer, but its complicated structure may narrow the application range.

SUMMARY

An advantage of some aspects of the invention is that a print device has a simple configuration to suppress a failure to eject a print medium to the outside even if the print medium is in an inclined position.

A print device according to a first aspect of the invention includes a transport route along which a print medium is transported in a transport direction. The print medium is to be inserted or ejected via a first opening at a first end of the transport route in the transport direction. The print medium is to be ejected via a second opening at a second end of the transport route in the transport direction. A transport roller provided on the transport route of the print medium transports the print medium inserted via the first opening. A housing guides the print medium on its one side in a direction orthogonal to the transport direction of the print medium. A head performs a print operation on the print medium. A stopper stops, at a preset position, a front end of the print medium inserted via the first opening by closing the transport route. A first sensor provided upstream of the stopper on the transport route detects presence of the print medium. A second sensor provided upstream of the first sensor on the transport route detects the presence of the print medium. A processor controls the transport roller, based on detection states of the first sensor and the second sensor. When a first command received from an external device designates the print medium to be ejected to an outside via the second opening and a length of the print medium determined from the detection states of the first sensor and the second sensor is shorter than or equal to a predetermined length based on a distance between the transport roller and the second opening, the processor ejects the print medium to the outside via the first opening.

According to the first aspect, even if the print medium that has been inserted via the first opening is designated to be ejected to the outside via the second opening, when the length of the print medium determined from the detection states of the first and second sensors is shorter than or equal to the predetermined length, the processor ejects the print medium to the outside via the first opening. In this way, if the length of the print medium is insufficient, the processor ejects the print medium to the outside via the opening via which the print medium has been inserted. Consequently, the print device can suppress a failure to eject the print medium to the outside without being restricted by settings regarding an operation of ejecting the print medium.

It is preferable that the first sensor be misaligned from the second sensor in the transport direction.

According to the above aspect, the processor determines the length of the print medium, based on the detection states of the first and second sensors misaligned from each other in the transport direction of the print medium. Consequently, the print device can suppress a failure to eject the print medium to the outside even if the print medium is in an inclined position.

It is preferable that the processor calculate the length of the print medium, based on an amount in which the print medium is transported over a period between when the front end of the print medium makes contact with the stopper and when the second sensor detects absence of a rear end of the print medium.

According to the above aspect, the print device has a simple configuration with the stopper to calculate the length of the print medium and, even if the print medium is in an inclined position, can suppress a failure to eject the print medium to the outside.

It is preferable that the processor eject the print medium to the outside via the first opening when the length of the print medium is shorter than or equal to the predetermined length that is the distance between the transport roller and the second opening.

According to the above aspect, the processor changes from the second opening to the first opening as an opening via which the print medium is to be ejected if it is difficult to transport the print medium to the second opening. Consequently, the print device can suppress a failure to eject the print medium to the outside without being restricted by settings regarding an operation of ejecting the print medium.

It is preferable that, when ejecting the print medium to the outside via the second opening, the processor transport the print medium based on the length of the print medium until the front end of the print medium protrudes from the second opening.

According to the above aspect, the processor transports the print medium to a position where a user can easily take out the print medium. If the print medium does not have an enough length to be transported to the above position, the processor changes ejection openings for the print medium. In this way, the print device can suppress a failure to eject the print medium to the outside.

It is preferable that the print device further include a roll sheet transport route along which a roll sheet is transported. This roll sheet transport route may overlap the transport route. The processor may perform the print operation on the roll sheet with the head when the first sensor detects absence of the print medium.

According to the above aspect, the print device, which performs the print operation either on the roll sheet or on the print medium inserted via the first opening, has a simple structure with the first sensor to detect the presence of the print medium inserted via the first opening and to determine the length of the print medium. Consequently, the print device can suppress a failure to eject the print medium to the outside even if an inclined position of the print medium may affect determination of the length of the print medium.

It is preferable that, even when the length of the print medium determined from the detection states of the first sensor and the second sensor is shorter than or equal to the predetermined length, the processor eject the print medium to the outside via the second opening designated by the first command, in response to a second command received from the external device.

According to the above aspect, the print device can suppress a failure to eject the print medium to the outside and can fixedly set an ejection direction for the print medium in response to commands. Consequently, the print device allows an operation of ejecting the print medium to be set in detail.

According to a second aspect of the invention, a method controls a print device that includes a transport route along which a print medium is transported in a transport direction. The print medium is to be inserted or ejected via a first opening at a first end of the transport route in the transport direction. The print medium is to be ejected via a second opening at a second end of the transport route in the transport direction. A transport roller provided on the transport route of the print medium transports the print medium inserted via the first opening. A housing guides the print medium on its one side in a direction orthogonal to the transport direction of the print medium. A head performs a print operation on the print medium. A stopper stops, at a preset position, a front end of the print medium inserted via the first opening by closing the transport route. In the above method, the print medium is transported based on detection states of a first sensor and a second sensor; the first sensor, which is provided upstream of the stopper on the transport route, detects presence of the print medium, and the second sensor, which is provided upstream of the first sensor on the transport route, detects the presence of the print medium. Then, the print medium is ejected to an outside via the first opening when a first command received from an external device designates the print medium to be ejected to the outside via the second opening and a length of the print medium determined from the detection states of the first sensor and the second sensor is shorter than or equal to a predetermined length based on a distance between the transport roller and the second opening.

According to the second aspect, even if the print medium that has been inserted via the first opening is designated to be ejected to the outside via the second opening, when the length of print medium determined from the detection states of the first and second sensors is shorter than or equal to the predetermined length, the print medium is ejected to the outside via the first opening. By ejecting the print medium to the outside via the opening via which the print medium has been inserted, the print medium can be reliably ejected to the outside even when the length of the print medium is insufficient. Consequently, the above method can suppress a failure to eject the print medium to the outside without being restricted by settings regarding an operation of ejecting the print medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Some embodiments of the invention will be described below with reference to the accompanying drawings.

Configuration of Print Device

Figure 1:
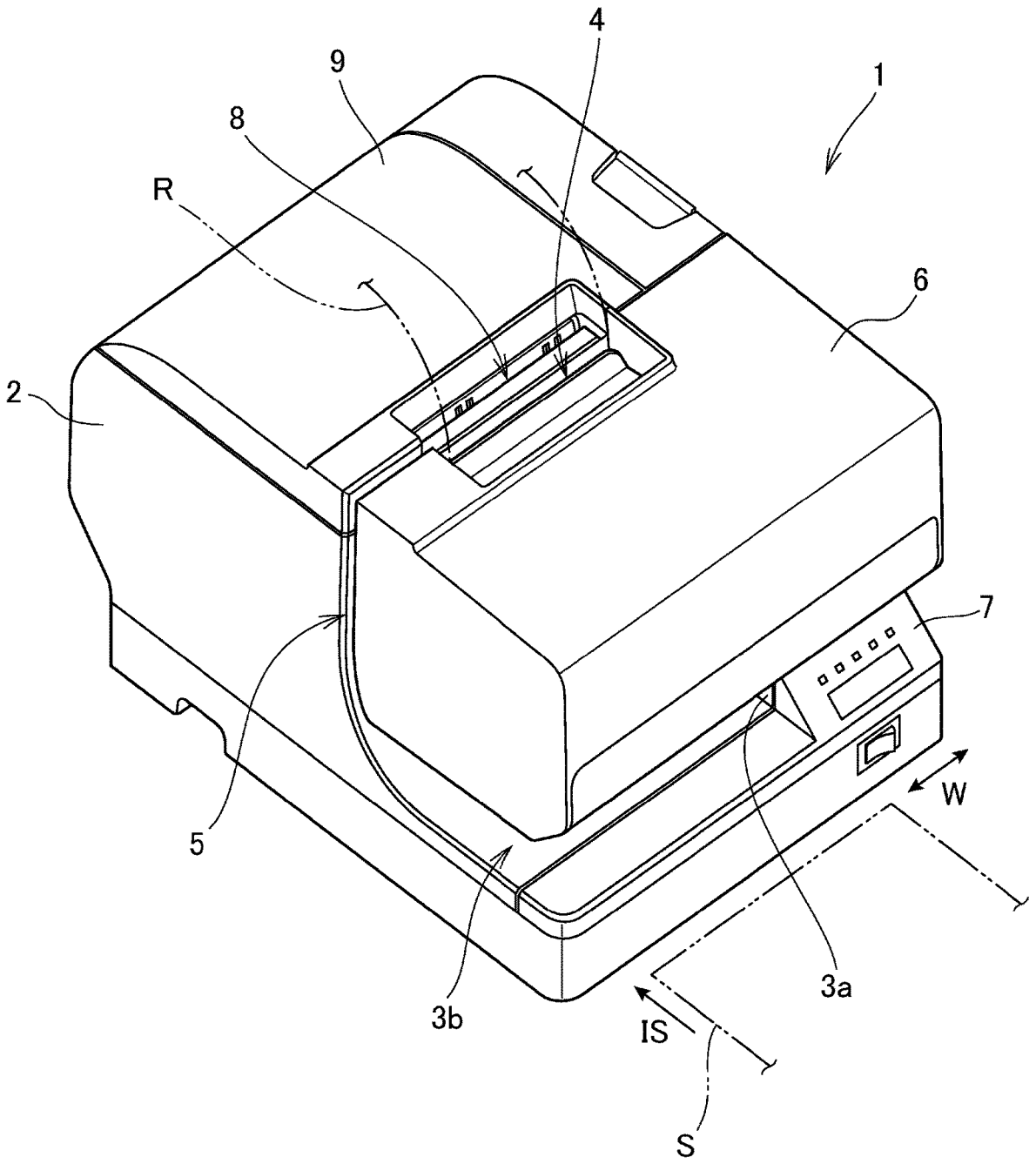
FIG. 1 is a perspective view of a print device according to one embodiment of the invention.

FIG. 1 is a perspective view of a print device 1 according to one embodiment of the invention. The print device 1 (printer, printing device) prints letters, characters, images, marks, or image codes on print media such as a cut sheet S and a roll sheet R. The cut sheet S may be formed by cutting paper or a synthetic resin into a predetermined size and treating its surface. As an example, the cut sheet S may be a check or other business form.

As illustrated in FIG. 1, the print device 1 may be placed and used on a desk, floor, dedicated table, or other flat surface. The print device 1 has a case 2, formed into a rectangular parallelepiped shape, that includes: an insertion opening 3 via which the cut sheet S is to be inserted; a cut-sheet ejection opening 4 via which the cut sheet S is to be ejected; and a roll-sheet ejection opening 8 via which the roll sheet R is to be ejected. When a user inserts the cut sheet S into the print device 1 via the insertion opening 3, the print device 1 performs a print operation on the cut sheet S; this operation is usually referred to as the "manual print operation". Herein, the case 2 corresponds to a housing; the insertion opening 3 corresponds a first opening; and the cut-sheet ejection opening 4 corresponds a second opening.

The print device 1 is placed with the insertion opening 3, the cut-sheet ejection opening 4, and the roll-sheet ejection opening 8 uncovered. Hereinafter, the surface of print device 1 on which the insertion opening 3 is provided is defined as the front surface, and the surface on which both the cut-sheet ejection opening 4 and the roll-sheet ejection opening 8 are provided is defined as the upper surface. In this case, the cut sheet S is inserted into the print device 1 via the insertion opening 3 on the front surface and ejected from the print device 1 to the outside via the cut-sheet ejection opening 4 on the upper surface. The roll sheet R is ejected from the print device 1 to the outside via the roll-sheet ejection opening 8 on the upper surface. However, the cut sheet S can also be ejected to the outside via the insertion opening 3, details of which will be described later.

In FIG. 1 and some other drawings, the lateral directions of the print device 1 are denoted by the character "W". Since the lateral directions are identical to width directions of the cut sheet S, they are referred to below as the width directions W. The direction in which the cut sheet S is inserted into the print device 1 via the insertion opening 3 is defined as the insertion direction IS.

The print device 1 is connected to an unillustrated point-of-sale (POS) terminal, for example, that performs an accounting process for merchandise sale. In this example, the print device 1 prints letters or images on the roll sheet R to produce a receipt, debit note, slip, or other document. The cut sheet S is used as a business form for a check or payment. In this case, the print device 1 prints cover address matters, such as a payee, date, amount of money, on the cut sheet S.

Each of the insertion opening 3, the cut-sheet ejection opening 4, and the roll-sheet ejection opening 8 is provided so as to extend in the width directions W. Provided between the insertion opening 3 and the cut-sheet ejection opening 4 is a transport route 5. Further, the transport route 5 extends backward from the insertion opening 3 and is curved upward to the cut-sheet ejection opening 4. Providing the insertion opening 3, the cut-sheet ejection opening 4, and the transport route 5 in this manner forms a recess on the left surface of the case 2.

The case 2 is provided with the insertion opening 3 on the front surface of the print device 1, an open end 3*b* on one side of the print device 1, and a guide surface 3*a* exposed via the insertion opening 3. The guide surface 3*a* makes contact with the side edge of the insertion opening 3 on the other side of the print device 1. The open end 3*b* is connected to both the cut-sheet ejection opening 4 and the transport route 5. When the user inserts the cut sheet S via the insertion opening 3 with the side portion of the cut sheet S exposed to the outside via the open end 3*b*, the print device 1 transports the cut sheet S to the cut-sheet ejection opening 4 along the transport route 5 while keeping the side portion exposed.

The guide surface 3*a* is a wall formed so as to continue in the transport direction of the cut sheet S, namely, in the downstream direction. The user can use the guide surface 3*a* as a guide for inserting the cut sheet S into the print device 1 via the insertion opening 3. More specifically, the user can insert the cut sheet S via the insertion opening 3 with one side edge of the cut sheet S being in contact with the guide surface 3*a*. This structure can suppress the cut sheet S from being inclined.

As described above, the print device 1 can transport the cut sheet S with its side portion in the width directions W protruding from the case 2. This structure enables the print device 1 to perform the print operation on the cut sheet S even if the cut sheet S is larger in size than any of the insertion opening 3, the cut-sheet ejection opening 4, and the transport route 5 in the width directions W.

The insertion opening 3 is larger in size than the transport route 5 in a vertical direction, namely, a height direction of the print device 1. This structure, even if the cut sheet S is small in size, permits the user to insert the cut sheet S into the print device 1 by putting his/her fingers in the insertion opening 3. Therefore, when the print device 1 ejects the cut sheet S via the insertion opening 3, the user can enter the fingers in the insertion opening 3 and take out the cut sheet S, details of which will be described later.

The portion of the upper surface of the case 2 which is positioned forward of the cut-sheet ejection opening 4 is covered with a front cover 6. Provided on the front of the case 2 is an operation panel 7, which includes: a switch for use in performing various operations of the print device 1; and an indicator that indicates operational statuses of the print device 1.

Attached to the portion of the upper surface of the case 2 which is positioned backward of the roll-sheet ejection opening 8 is an opening/closing cover 9, which is rotatable around its rear edge. When the opening/closing cover 9 is opened, a roll sheet container 58 (see FIG. 2) that accommodates the roll sheet R is exposed, which allows the user to replace the roll sheet R with another. The roll sheet R may be formed by winding a long, regular paper sheet around a core.

Figure 2:
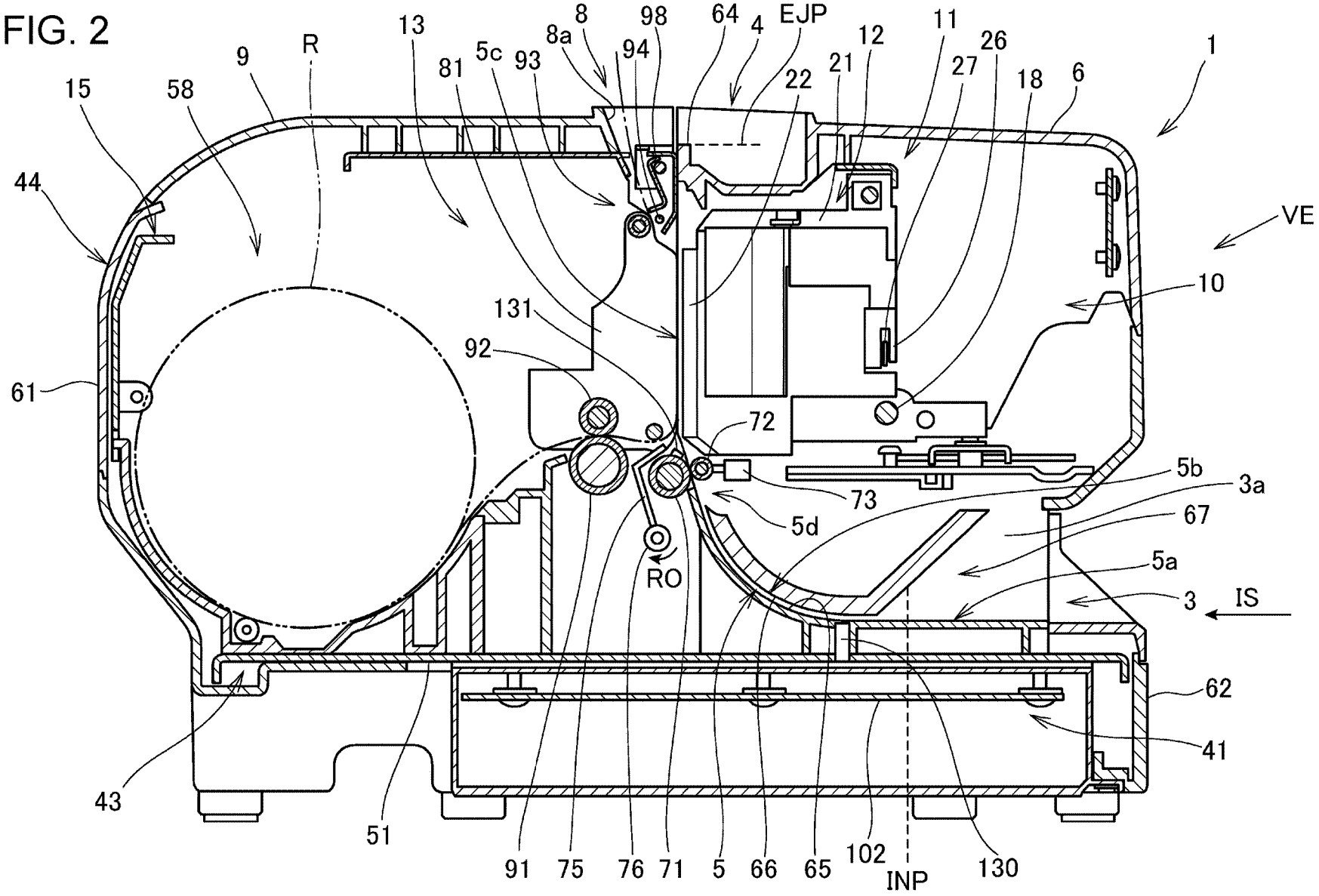
FIG. 2 is a cross-sectional view of a key part of the print device.

FIG. 2 is a cross-sectional view of a key part of the print device 1. In FIG. 2, the right side corresponds to the front side of the print device 1, and the left side corresponds to the rear side of the print device 1. The case 2 in the print device 1 contains a main body 11 that includes: a print unit 10 that performs the print operation on the cut sheet S and the roll sheet R; a cut sheet process section 12 that transports the cut sheet S; and a roll sheet process section 13 that transports the roll sheet R. Furthermore, the main body 11 includes a frame 15, made of a metal, that supports various sections, including the print unit 10, the main body 11, and the cut sheet process section 12.

The print unit 10 is disposed inside the front cover 6 and includes a carriage 21 on which a print head 22 and unillustrated ink cartridges are mounted. The print head 22, which may be an ink jet print head, is disposed opposite a platen 81. The print head 22 discharges inks from the ink cartridges onto the cut sheet S and the roll sheet R positioned in front of the platen 81, thereby performing the print operation on them. Herein, the print head 22 corresponds to a head.

The carriage 21 is supported by a carriage guide shaft 18 fixed to the frame 15. The carriage guide shaft 18 is provided so as to extend in the width directions W of the main body 11 and may include a plurality of shafts. The carriage 21 reciprocates along the carriage guide shaft 18 by means of the driving power from a carriage drive motor 141 (see FIG. 3) to scan the cut sheet S and the roll sheet R. This movement enables the print head 22 to perform the print operation on the substantially entire surface areas of the cut sheet S and the roll sheet R.

The print unit 10 further includes a carriage position sensor 26 that detects a position of the carriage 21 in the width directions W. The carriage position sensor 26 optically reads a measurement of a ruler 27 disposed along the carriage guide shaft 18. In short, the combination of the carriage position sensor 26 and the ruler 27 functions as a linear encoder. Thus, the carriage position sensor 26 can detect the position of the carriage 21, based on a varying measurement of the ruler 27.

Provided in a lower portion of the print device 1 is a substrate accommodation chamber 41, which is the space defined by a base frame 51, a subframe 43, and the panel 44; the base frame 51 is a part of the frame 15, the subframe 43 is fixed to the base frame 51, and the panel 44 covers the subframe 43. The substrate accommodation chamber 41 contains a control substrate 102 on which various circuits that constitute the control system of the print device 1 are mounted.

The panel 44, which includes the front cover 6, a rear cover 61, the opening/closing cover 9, and a lower cover 62, forms an exterior of the case 2.

The cut sheet process section 12 is disposed in a front portion of the main body 11 and transports the cut sheet S. The cut sheet process section 12 includes a transport roller 71 and a driven roller 72. Furthermore, the cut sheet process section 12 may include a lower guide surface 65, an upper guide surface 66, a sheet guide 67, the insertion opening 3, and the cut-sheet ejection opening 4, which constitute the transport route 5 of the cut sheet S.

The transport route 5 includes: a horizontal section 5*a* that extends from the insertion opening 3 to the rear of the print device 1; a curved section 5*b* that is curved upward from the horizontal section 5*a*; and a vertical section 5*c* that extends upward from the curved section 5*b*. The vertical section 5*c* extends until its upper end reaches the cut-sheet ejection opening 4.

Provided inside the print device 1 near the insertion opening 3 are a bottom surface and the sheet guide 67 that faces the lower guide surface 65. The bottom surface corresponds to the lower guide surface 65, and the lower surface of the sheet guide 67 corresponds to the upper guide surface 66. The horizontal section 5*a* and the curved section 5*b* are provided in the space defined by the lower guide surface 65 and the upper guide surface 66.

In the curved section 5*b*, both the transport roller 71 and the driven roller 72 are disposed opposite each other with a portion of the curved section 5*b* therebetween. The driven roller 72 is supported by a roller moving section 73, which may be a plunger, so as to be movable to or away from the curved section 5*b*. The driven roller 72 moves to the transport route 5 in response to the extension of the roller moving section 73 and moves away from the transport route 5 in response to the contraction of the roller moving section 73.

While being positioned in the curved section 5*b*, the driven roller 72 abuts against the transport roller 71 at a predetermined nip force. The transport roller 71 rotates by means of the driving power from a cut sheet transport motor 143 (see FIG. 3), and the driven roller 72 rotates together with the transport roller 71. The combination of the transport roller 71 and the driven roller 72 functions as a transport section that transports the cut sheet S positioned in the curved section 5*b* while pinching it therebetween. The cut sheet transport motor 143 is rotatable in two directions: a forward direction and a reverse direction. Depending on the rotational direction of the cut sheet transport motor 143, both the transport roller 71 and the driven roller 72 transport the cut sheet S to either the cut-sheet ejection opening 4 or the insertion opening 3.

The vertical section 5*c* is a transport route extending from the position between the platen 81 and the print head 22 to the cut-sheet ejection opening 4. While the cut sheet S is moving in the vertical section 5*c*, the print head 22 is performing the print operation on the cut sheet S. After the print operation is performed in the vertical section 5*c*, the cut sheet S is transported upward by both the transport roller 71 and the driven roller 72 and then ejected to the outside via the cut-sheet ejection opening 4.

Provided in the vertical section 5*c* is a stopper 75, which is movable to or away from the transport route 5. The stopper 75 is supported by a stopper moving section 76, which is rotatable in both the direction indicated by the arrow RO in FIG. 2 and its reverse direction by means of power from an unillustrated motor. In response to the rotation of the stopper moving section 76, the stopper 75 moves to the transport route 5 to close it, or moves away from the transport route 5 to open it.

The stopper 75 blocks the front end of the cut sheet S inserted via the insertion opening 3 from moving into the vertical section 5*c*. When the stopper 75 moves to the transport route 5 and closes it, the cut sheet S inserted via the insertion opening 3 makes contact with the stopper 75. In which case, the cut sheet S can no longer move toward the vertical section 5*c*.

Disposed near the stopper 75 is a top of form (TOF) sensor 131, which detects presence of the cut sheet S on the transport route 5. The TOF sensor 131 may be a light reflective or transmissive sensor or a lever-operated switch. The TOF sensor 131 detects the presence of the cut sheet S near the stopper 75, more specifically at a position closer to the insertion opening 3 than the stopper 75. In other words, the TOF sensor 131 detects the presence of the cut sheet S on the upstream side in the transport direction of the cut sheet S between the insertion opening 3 and the cut-sheet ejection opening 4. More specifically, the TOF sensor 131 detects the presence of the cut sheet S inserted into the horizontal section 5*a* via the insertion opening 3. Herein, the TOF sensor 131 corresponds to a first sensor.

Disposed in the horizontal section 5*a* is a bottom of form (BOF) sensor 130, which detects presence of the cut sheet S on the transport route 5. The horizontal section 5*a* may be a light reflective or transmissive sensor or a lever-operated switch. Herein, the BOF sensor 130 corresponds to a second sensor.

In FIG. 1, an insertion position INP and an ejection position EJP are depicted, and each of them is a marker indicating a position of the cut sheet S on the transport route 5. The insertion position INP corresponds to a position at which the cut sheet S is inserted into the print device 1. The insertion position INP is on the upstream side of the detecting position of the BOF sensor 130 and a predetermined distance away from the insertion opening 3. More specifically, for example, the insertion position INP corresponds to a position at which the user's hand is accessible to the cut sheet S via the insertion opening 3. The ejection position EJP corresponds to a position at which the cut sheet S is ejected from the print device 1. More specifically, the ejection position EJP is at an upper portion of an ejection opening guide 64 around the cut-sheet ejection opening 4. More specifically, for example, the ejection position EJP corresponds to a position at which the user's hand is accessible to the cut sheet S protruding from the cut-sheet ejection opening 4.

The roll sheet process section 13 includes a transport roller 91, a driven roller 92, the transport roller 71, and the driven roller 72, all of which transport the roll sheet R. Furthermore, the roll sheet process section 13 may include a roll sheet container 58, a roll-sheet ejection opening 8, a transport roller 93, and a driven roller 94. Herein, each of the transport roller 91, the transport roller 71, and the transport roller 93 corresponds to a drive roller.

The roll sheet container 58 rotatably supports the roll sheet R from the bottom. Disposed in front of the roll sheet container 58 are both the transport roller 91 and the driven roller 92. The transport roller 91 is coupled to a roll sheet transport motor 144 (see FIG. 3) and rotates by means of the driving power from the roll sheet transport motor 144. The driven roller 92 abuts against the transport roller 91 at a predetermined nip force and rotates together with the transport roller 91. Both the transport roller 91 and the driven roller 92, which function as a roll sheet transport section, pinch the roll sheet R fed from the roll sheet container 58 and then transport the roll sheet R to the vertical section 5*c* while rotating by means of the driving power from the roll sheet transport motor 144.

After both the transport roller 91 and the driven roller 92 transport the roll sheet R to the vertical section 5*c*, the print head 22 performs the print operation on the roll sheet R. The vertical section 5*c* corresponds to a transport route shared by the cut sheet S and the roll sheet R. Therefore, the roll sheet transport route along which the roll sheet R is transported overlaps the vertical section 5*c*, which a part of the transport route 5.

Formed in the upper portion of the print device 1 and in back of the cut-sheet ejection opening 4 is the roll-sheet ejection opening 8. The vertical section 5*c* is divided, at its upper position, into two subsections on the cut-sheet ejection opening 4 side and on the roll-sheet ejection opening 8 side. Disposed in the upper portion of the vertical section 5*c* are both the transport roller 93 and the driven roller 94 so as to face each other. The transport roller 93 is coupled to the roll sheet transport motor 144 (see FIG. 3) and rotates by means of the driving power from the roll sheet transport motor 144. The driven roller 94 abuts against the transport roller 93 at a predetermined nip force and rotates together with the transport roller 93. Both the transport roller 93 and the driven roller 94 transport the roll sheet R that has been fed to the vertical section 5*c* to the roll-sheet ejection opening 8.

When the roll sheet R is placed inside the print device 1, the roll of the roll sheet R is accommodated in the roll sheet container 58. The roll sheet R is fed from the roll and interposed between the transport roller 91 and the driven roller 92. Then, the roll sheet R is fed to the vertical section 5*c* and interposed between the transport roller 93 and the driven roller 94. In this way, the cut sheet S is transported in the vertical section 5*c* while overlaid on the roll sheet R.

Disposed near the roll-sheet ejection opening 8 is a cutter 98, which is a fixed blade such as a saw blade. The user catches hold of the front end of the roll sheet R that the print device 1 has ejected to the outside via the roll-sheet ejection opening 8 and then presses the roll sheet R against the cutter 98, thereby cutting the roll sheet R.

Configuration of Control System in Print Device

Figure 3:
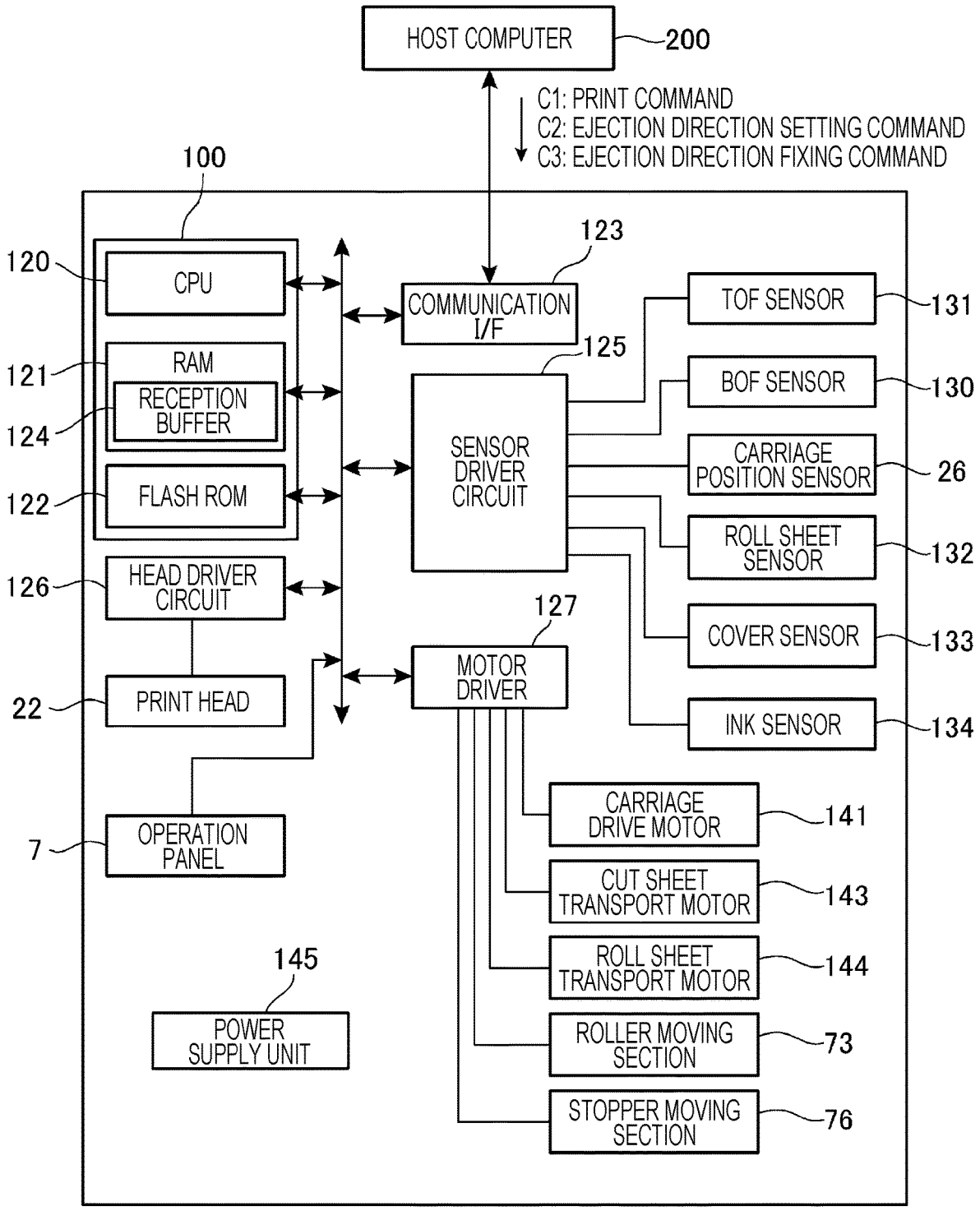
FIG. 3 is a block diagram of a control system in the print device.

FIG. 3 is a block diagram of the control system in the print device 1. The print device 1 includes a controller 100 that controls individual sections. The controller 100 includes: a central processing unit (CPU) 120 that executes a control program to control the sections; a random access memory (RAM) 121 that generates a work area and temporality stores, for example, programs to be executed or data to be processed by the CPU 120 in the work area; and a flash ROM 122 in which basic programs to be executed by the CPU 120 and various setting values are stored. The sections in the controller 100 may be mounted on the control substrate 102. Herein, the controller 100 corresponds to a processor.

The print device 1 includes a communication interface (I/F) 123 that serves as a communicator through which, for example, commands or data is transmitted to or received from a host computer 200. In this case, the host computer 200 may be an external device. The communication I/F 123 includes: a communication circuit, such as that containing communication ICs, which performs a communication process; and an I/P board on which the communication circuit is mounted. The RAM 121 includes a reception buffer 124 in which commands or data received from the host computer 200 through the communication I/F 123 is temporarily stored. The CPU 120 reads, for example, programs or data temporarily stored in the RAM 121 and further reads commands stored in the reception buffer 124 in order of reception time and executes them.

Examples of commands that host computer 200 transmits to the print device 1 include, but not limited to: a print command C1 for use in instructing the print operation; and setting commands for use in setting the operation of the print device 1. Examples of the setting commands include, but not limited to: an ejection direction setting command C2 for use in designating a direction in which the print device 1 ejects the cut sheet S; and an ejection direction fixing command C3 for use in fixing the ejection direction. However, such executable commands that the print device 1 receives from the host computer 200 are not limited to the above examples. As an alternative example, the commands may be a selection command, an insertion command, and a paper ejection command that the print device 1 receives from the host computer 200 during an operation that will be described later with reference to FIG. 10. Herein, the ejection direction setting command C2 corresponds to a first command, and the ejection direction fixing command C3 corresponds to a second command.

The controller 100 is connected to a sensor driver circuit 125, a head driver circuit 126, and a motor driver 127. The sensor driver circuit 125 converts detected values of the sensors into digital data and outputs it to the controller 100; the head driver circuit 126 drives the print head 22; and the motor driver 127 operates drivers, including motors.

The above functional sections may be implemented in any given fashion. For example, each of the functional sections may be implemented using an independent semiconductor device, or some of the functional sections may be implemented using a single system-on-a-chip (SOC) device.

The head driver circuit 126 supplies a drive current to the print head 22 to discharge inks via nozzles, under the control of the controller 100.

The sensor driver circuit 125 is connected to the BOF sensor 130, the TOF sensor 131, a roll sheet sensor 132, a cover sensor 133, an ink sensor 134, and the carriage position sensor 26. The roll sheet sensor 132 may be a switch type sensor, which is turned on when the outer diameter of the roll sheet R accommodated in the roll sheet container 58 is equal to or more than a predetermined value. The cover sensor 133 may be a switch type sensor, which is turned on when the opening/closing cover 9 is opened. The cover sensor 133 may output a high-level signal in an open state and outputs a low-level signal in a closed state. The ink sensor 134 detects the remaining amounts of inks in the unillustrated ink cartridges mounted in the carriage 21.

The carriage position sensor 26 detects the position of the carriage 21 by acquiring an optical signal that has passed through slits in the ruler 27. The ruler 27 has light-transmitting parts and light-shielding parts alternately arranged at equal intervals. The carriage position sensor 26 receives the light that has passed through the light-transmitting parts of the ruler 27 and outputs a detected value in accordance with the amount of the light received. The detected value output from the carriage position sensor 26 varies the number of times related to a moving distance of the carriage 21. Therefore, the controller 100 determines the moving distance of the carriage 21, based on a varying detected value output from the carriage position sensor 26, thereby locating the carriage 21.

The sensor driver circuit 125 converts the values output from the BOF sensor 130, the TOF sensor 131, the roll sheet sensor 132, the cover sensor 133, the ink sensor 134, and the carriage position sensor 26 into digital data and outputs it to the controller 100.

The motor driver 127 is connected to the carriage drive motor 141, the cut sheet transport motor 143, the roll sheet transport motor 144, the roller moving section 73, and the stopper moving section 76. The motor driver 127 outputs drive currents or drive pulses to these drivers.

The print device 1 includes a power supply unit 145 that applies direct-current (DC) voltages to individual sections, including the motor driver 127. For example, the motor driver 127 drives the individual sections with a DC voltage of 24 V generated by the driving power supply unit 145. The controller 100 is connected to an operation panel 7. The controller 100 detects operation states of switches provided in the operation panel 7 and controls lighting of indicators provided in the operation panel 7.

Configuration of Controller

Figure 4:
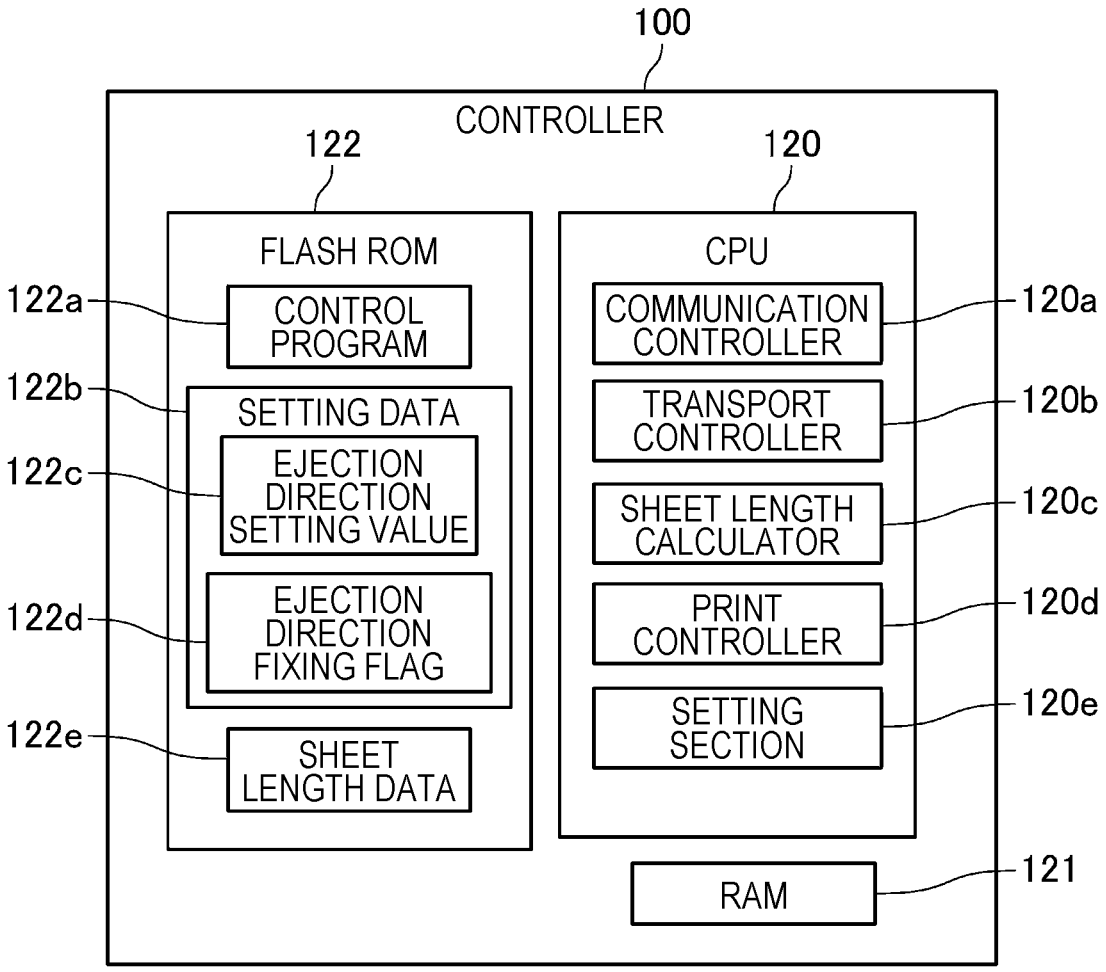
FIG. 4 is a functional block diagram of a controller in the print device.

FIG. 4 is a functional block diagram of the controller 100 in the print device 1. A control program 122*a*, which is to be executed by the CPU 120, is stored in the flash ROM 122. The CPU 120 reads and executes the control program 122*a*, thereby functioning as a communication controller 120*a*, a transport controller 120*b*, a sheet length calculator 120*c*, a print controller 120*d*, and a setting section 120*e*. In other words, the CPU 120 executes the control program 122*a* to cause software and hardware to cooperate with each other, thereby realizing these functional blocks.

Stored in the flash ROM 122 are setting data 122*b* and sheet length data 122*e*. The setting data 122*b* contains an ejection direction setting value 122*c* and an ejection direction fixing flag 122*d*. When the CPU 120 temporarily uses the setting data 122*b* or the sheet length data 122*e*, it is once stored in the RAM 121 and read therefrom.

The communication controller 120*a* receives commands and data from the host computer 200 through the communication I/F 123 and stores the received commands or data in the reception buffer 124 within the controller 100. The CPU 120 sequentially reads the commands from the reception buffer 124 and executes the read commands. For example, when the CPU 120 reads the print command C1 from the reception buffer 124, the print controller 120*d* in the CPU 120 executes the read print command C1. When the CPU 120 reads the ejection direction setting command C2 or the ejection direction fixing command C3 from the reception buffer 124, the setting section 120*e* in the CPU 120 makes various settings in accordance with the read command.

The transport controller 120*b* drives the cut sheet transport motor 143 to transport the cut sheet S and also drives the roll sheet transport motor 144 to transport the roll sheet R. In addition, the transport controller 120*b* causes the roller moving section 73 to move the driven roller 72 to or away from the transport route 5 and also causes the stopper moving section 76 to move the stopper 75 to or away from the transport route 5.

The sheet length calculator 120*c* calculates a length of the cut sheet S inserted into the print device 1 via the insertion opening 3, based on a transport amount of the cut sheet S controlled by the transport controller 120*b* and detection states of the BOF sensor 130 and the TOF sensor 131.

The print controller 120*d* causes the head driver circuit 126 to perform the print operation on the cut sheet S and the roll sheet R, in accordance with the print command C1.

The setting section 120*e* executes the ejection direction setting command C2 and the ejection direction fixing command C3 to make settings regarding an ejection direction of the cut sheet S.

The setting data 122*b* stored in the flash ROM 122 contains preset setting values regarding the operation of the print device 1. These setting values may indicate a font type and size of letters to be printed on the cut sheet S and roll sheet R and a linefeed width between these letters. As the setting values to be set by the setting section 120*e*, the setting data 122*b* contains the ejection direction setting value 122*c* and the ejection direction fixing flag 122*d*.

The ejection direction setting value 122*c* is used to designate a direction in which the cut sheet S inserted via the insertion opening 3 is to be ejected. The ejection direction setting value 122*c* may designate one of the direction toward the insertion opening 3 and the direction toward the cut-sheet ejection opening 4. The ejection direction setting command C2 designates which of the insertion opening 3 and the cut-sheet ejection opening 4 is to be set to the ejection direction for the cut sheet S. In accordance with the ejection direction setting command C2, the setting section 120*e* sets or updates the ejection direction setting value 122*c*.

The ejection direction fixing flag 122*d* is a flag indicating whether the ejection direction for the cut sheet S is fixed. The ejection direction fixing flag 122*d* may be either "1" or "0". For example, when the ejection direction fixing flag 122*d* is set to "1", the ejection opening may be fixed. When the ejection direction fixing flag 122*d* is set to "0", the ejection opening may be changeable. Exceptionally, even when the ejection direction setting value 122*c* is set such that the cut sheet S is ejected in the direction toward the cut-sheet ejection opening 4, the controller 100 may eject the cut sheet S via the insertion opening 3, details of which will be described later. However, when the ejection direction fixing flag 122*d* is set to "1", which indicates that the ejection direction is fixed, the controller 100 does not perform this exceptional operation and ejects the cut sheet S in the direction represented by the ejection direction setting value 122*c*. The setting section 120*e* sets or updates the ejection direction fixing flag 122*d* in accordance with the ejection direction fixing command C3.

The sheet length data 122*e* contains: the length of the cut sheet S calculated by the sheet length calculator 120*c*; and a reference length for use in making determination as to the length of the cut sheet S.

Operation of Print Device

FIGS. 5 to 8 each illustrate an operation of the print device 1 in which the cut sheet S is transported. Further, each of FIGS. 5 to 8 depicts the transport route 5 in a two-dimensional fashion as seen from the direction of the arrow VE in FIG. 2. In addition, the insertion position INP and the ejection position EJP in FIG. 2 are marked, and transport directions of the cut sheet S along the transport route 5 and scanning directions of the print head 22 are denoted by the characters F and SC, respectively. The print device 1 can transport the cut sheet S along the transport route 5 in the two directions: the direction toward the insertion opening 3 and the direction toward the cut-sheet ejection opening 4. Hereinafter, with respect to the direction in which the cut sheet S is to be inserted, the insertion opening 3 side of the transport route 5 is referred to as the upstream side, and the cut-sheet ejection opening 4 side of the transport route 5 is referred to as the downstream side. In each of the pages of FIGS. 5 to 8, the upper side corresponds to the downstream side, and the lower side corresponds to the upstream side.

In each of FIGS. 5 to 8, the ejection position EJP is on the boundary between an inside I and an outside O of the print device 1. The BOF sensor 130, the driven roller 72, the TOF sensor 131, the stopper 75, and the print head 22 are positioned along the transport route 5 in this order from the upstream side to the downstream side. It should be noted that the transport roller 71 positioned near and opposite the driven roller 72 is not illustrated.

Figure 5:
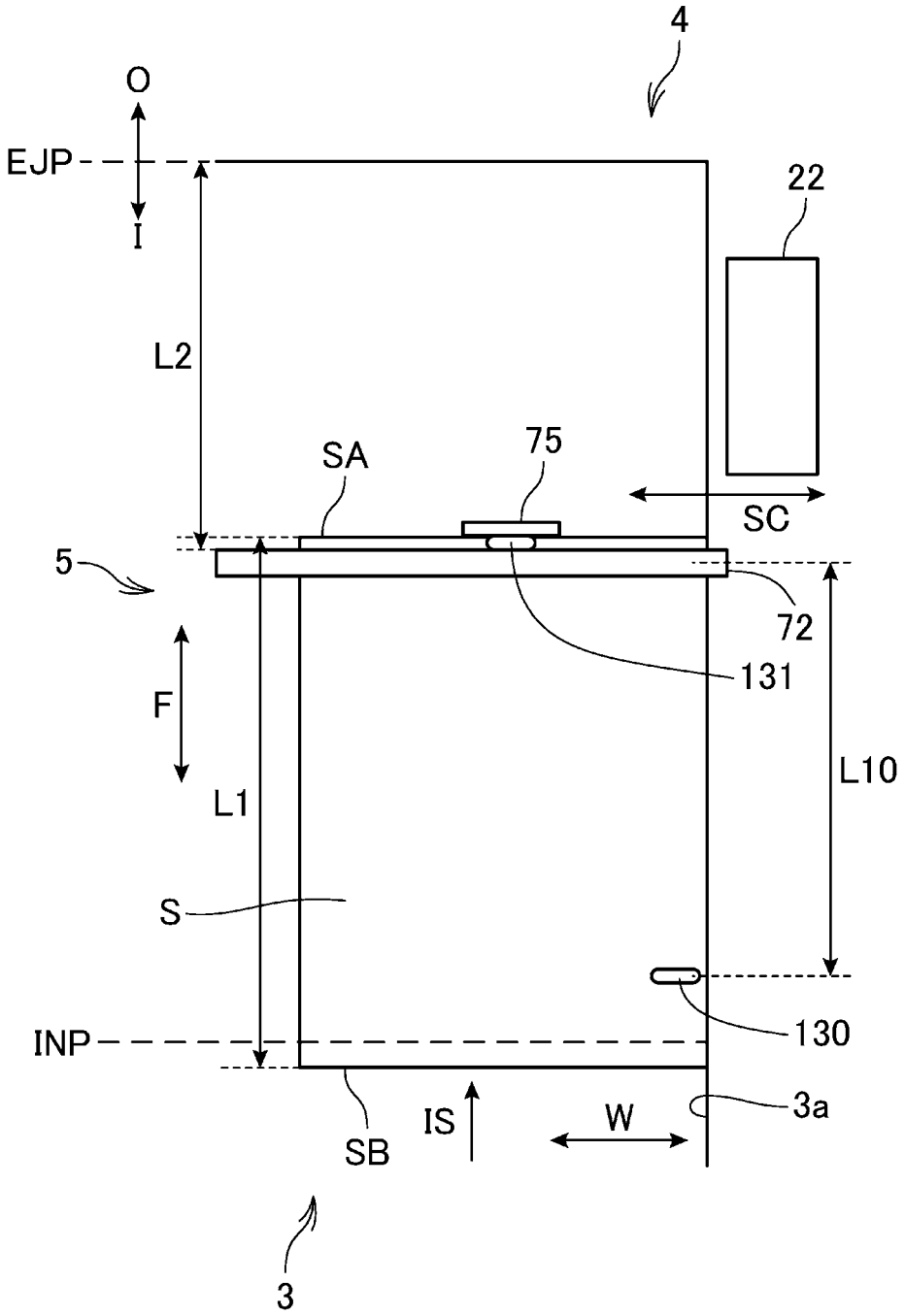
FIG. 5 is a schematic diagram illustrating the operation of the print device in which a cut sheet is transported.

As illustrated in each of FIGS. 5 to 8, the BOF sensor 130 and the TOF sensor 131 are disposed at different positions in the width directions W. More specifically, the BOF sensor 130 is positioned near the guide surface 3*a*, namely, near the blocked side of the transport route 5 in the width directions W, whereas the TOF sensor 131 is positioned near the center of the transport route 5 in the width directions W. In order to reliably stop the transport of the cut sheet S, the stopper 75 is preferably disposed near the center of the transport route 5 in the width directions W rather than near an either side of the transport route 5. In addition, since the TOF sensor 131 is disposed near the stopper 75, it can accurately detect whether the cut sheet S is in contact with the stopper 75. In FIG. 5, the distance between the BOF sensor 130 and the position at which transport roller 71 is in contact with the driven roller 72 is denoted by the character L10.

In FIG. 5, the transport of the cut sheet S inserted via the insertion opening 3 in the insertion direction IS is stopped with a front end SA being in contact with the stopper 75. In this state, both of the BOF sensor 130 and the TOF sensor 131 can detect the cut sheet S. If the transport controller 120*b* moves the stopper 75 away from the transport route 5, the cut sheet S resumes being transported in the upward direction of the page of FIG. 5. When a rear end SB of the cut sheet S passes by the BOF sensor 130, the BOF sensor 130 switches from the detection state to the non-detection state. Based on the distance between the stopper 75 and the BOF sensor 130 and an amount in which the cut sheet S is transported over a period between when the cut sheet S resumes being transported and when the BOF sensor 130 switches to the non-detection state, the sheet length calculator 120*c* calculates a length of the cut sheet S as a length L1.

Figure 6:
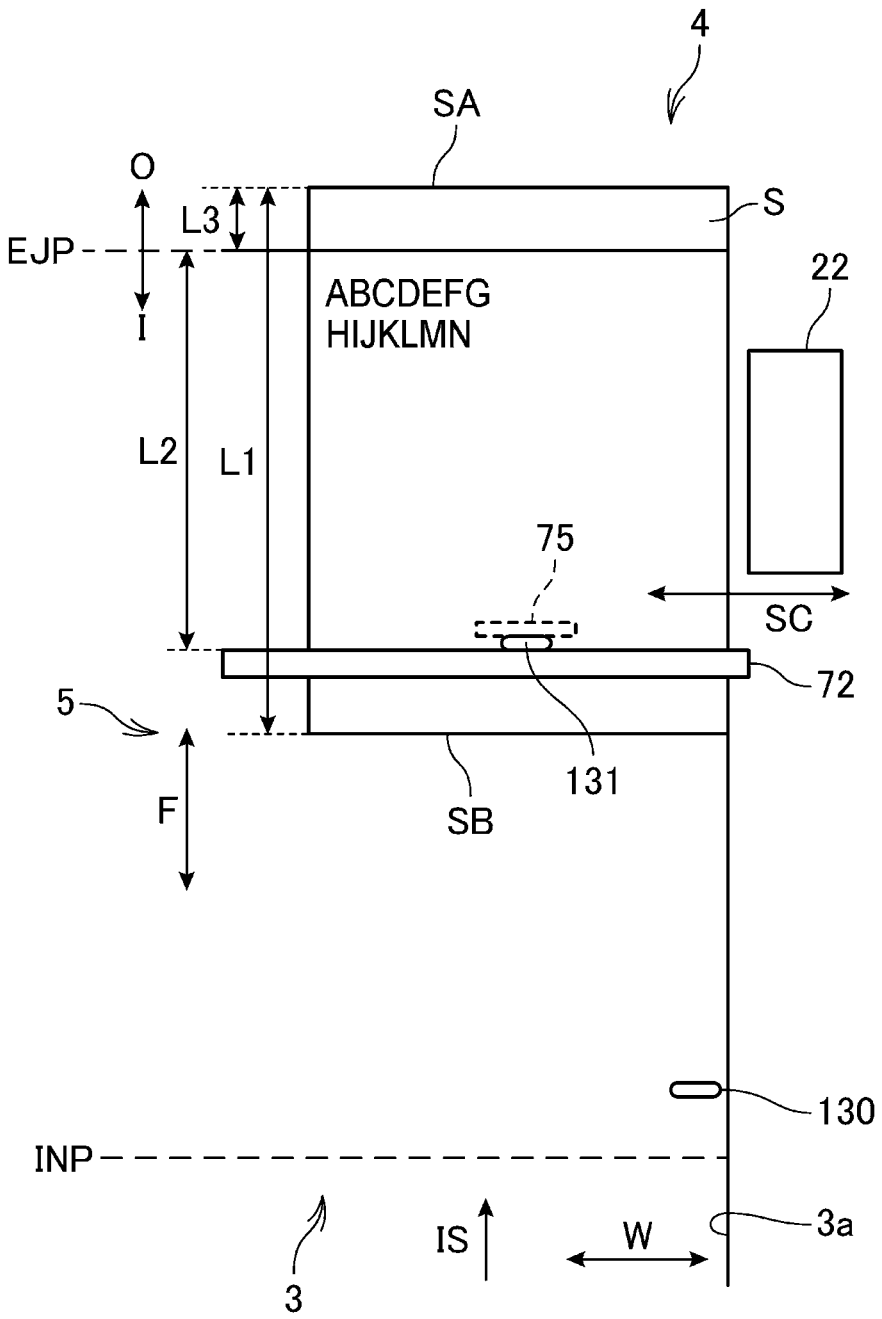
FIG. 6 is another schematic diagram illustrating the operation of the print device in which the cut sheet is transported.

FIG. 6 illustrates the cut sheet S being ejected via the cut-sheet ejection opening 4. After the print controller 120*d* performs the print operation on the cut sheet S, the transport controller 120*b* transports the cut sheet S until or immediately before the driven roller 72 breaks the contact with the transport roller 71. In the example of FIG. 6, the front end SA of the cut sheet S protrudes from the ejection position EJP by a length L3. In this state, the user can take out the cut sheet S by catching hold of the exposed portion via the ejection opening guide 64 (see FIG. 2).

In the example of FIG. 6, the length L1 of the cut sheet S is considerably greater than a distance L2 between the driven roller 72 and the ejection position EJP. Therefore, when the cut sheet S is interposed between the transport roller 71 and the driven roller 72, the front end SA of the cut sheet S can protrude from the ejection position EJP by the length L3.

Figure 7:
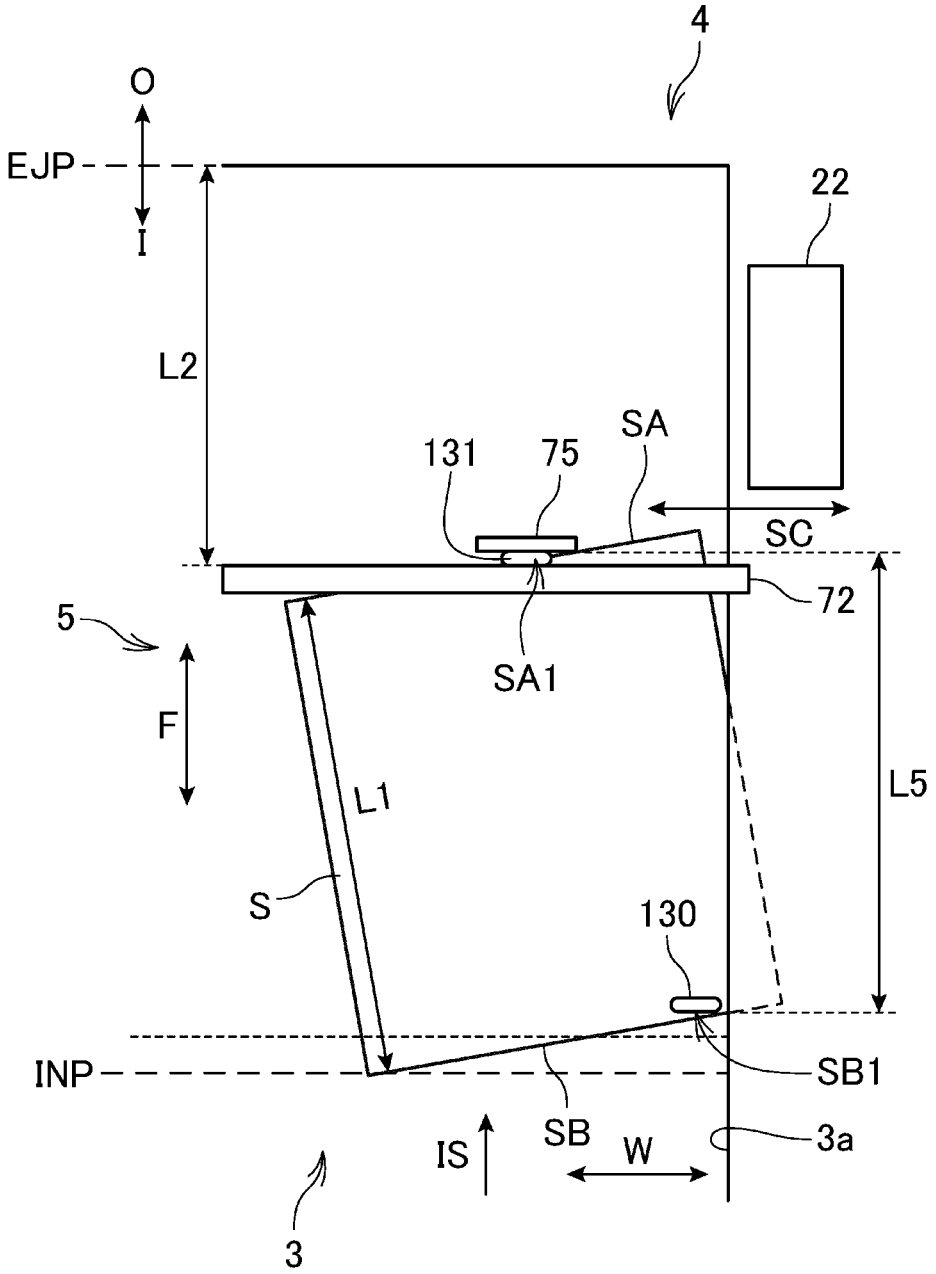
FIG. 7 is further another schematic diagram illustrating the operation of the print device in which the cut sheet is transported.

In the state of FIG. 7, similar to that of FIG. 5, the cut sheet S that has been inserted via the insertion opening 3 in the insertion direction IS is in contact with the stopper 75. However, the cut sheet S is in an inclined position.

The cut sheet S in the inclined position is transported while being interposed between the transport roller 71 (FIG. 2) and the driven roller 72. In this case, the cut sheet S curls up on the guide surface 3*a*, and then the print operation is performed on it. In the example of FIG. 7, the length of the cut sheet S calculated by the sheet length calculator 120*c* is shorter than the length L1, which is an actual length of the cut sheet S. More specifically, the sheet length calculator 120*c* calculates a distance between a contact portion SA1 and a detected portion SB1 in the transport directions F; the contact portion SA1 is where the front end SA is in contact with the stopper 75, and the detected portion SB1 is where the rear end SB is positioned at the detection site of the BOF sensor 130. Then, the sheet length calculator 120*c* sets the calculated distance to a length L5 of the cut sheet S.

In many cases, the length L5, which is calculated by the sheet length calculator 120*c*, is shorter than the length L1, especially when the transport of the cut sheet S is stopped by the stopper 75 with a portion of the front end SA positioned downstream of the stopper 75, as illustrated in FIG. 7.

Figure 8:
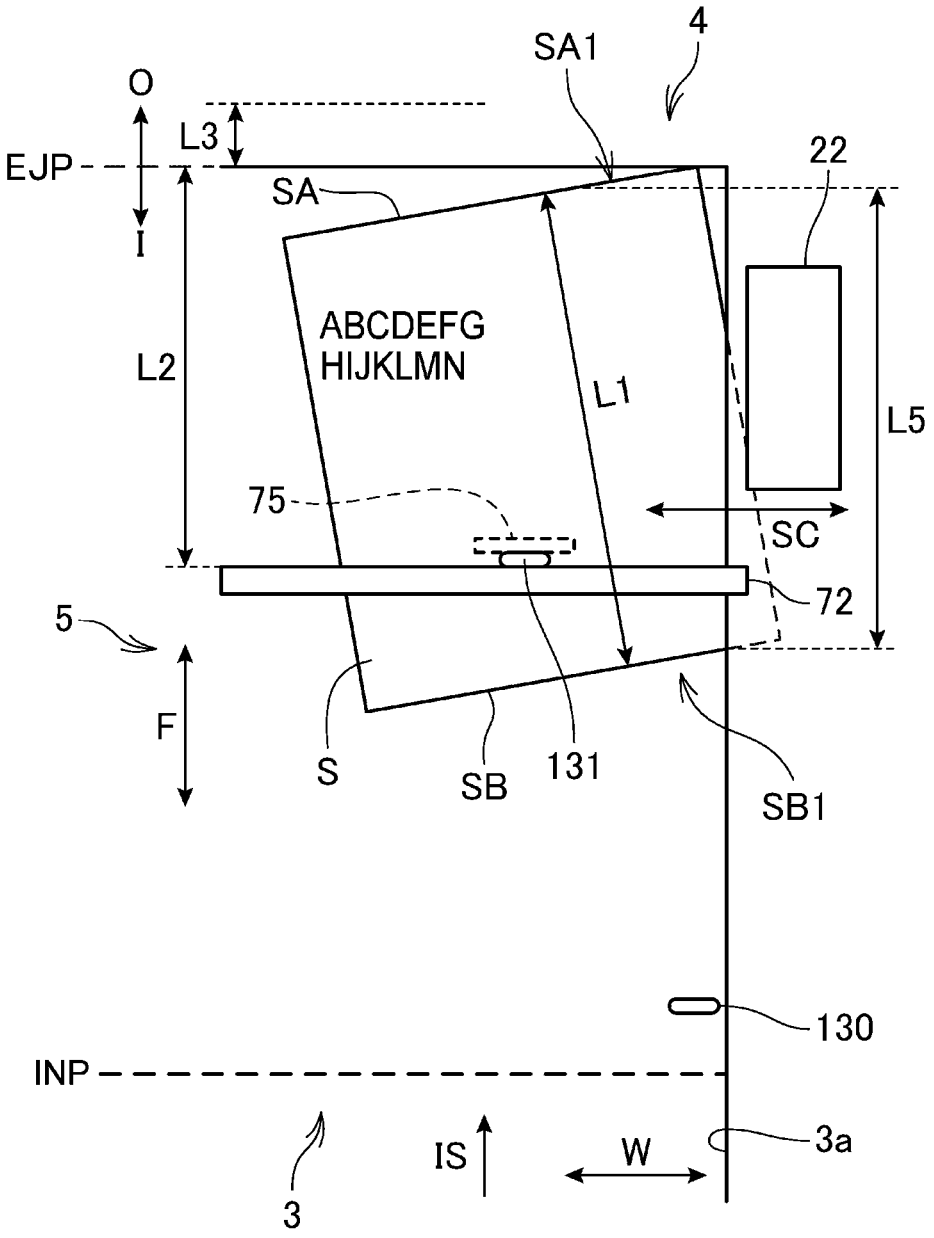
FIG. 8 is still another schematic diagram illustrating the operation of the print device in which the cut sheet is transported.

In the state of FIG. 8, similar to that of FIG. 6, the cut sheet S is being ejected via the cut-sheet ejection opening 4. However, the cut sheet S is in an inclined position, similar to the state in FIG. 7. The print controller 120*d* transports the cut sheet S until or immediately before the driven roller 72 breaks the contact with the transport roller 71, based on the length L5 of the cut sheet S calculated by the sheet length calculator 120*c*. Since the length L5 of the cut sheet S calculated by the sheet length calculator 120*c* is shorter than the length L1 in the example of FIG. 8, the transport controller 120*b* may terminate the transport of the cut sheet S before the front end SA sufficiently protrudes from the ejection position EJP.

In the above case, the print controller 120*d* terminates the transport of the cut sheet S, based on the length L5 of the cut sheet S immediately before the cut sheet S passes by the driven roller 72. When the transport is terminated, the front end SA of the cut sheet S may be positioned on the inner side of the ejection position EJP or may protrude from the ejection position EJP by only a small amount, as illustrated in FIG. 8. In the state of FIG. 8, the user may have difficulty taking out the cut sheet S via the cut-sheet ejection opening 4, in other words, an ejection failure may occur.

In FIG. 8, the protrusion amount of the cut sheet S in FIG. 6 is denoted by the character L3, for reference. As described above, an inclined position of the cut sheet S may be a cause of an ejection failure, although the cut sheet S could protrude from the ejection position EJP by the length L3 if the cut sheet S were in a straight position.

The print device 1 in this embodiment, if the length L5 of the cut sheet S calculated by the sheet length calculator 120*c* is insufficient, ejects the cut sheet S to the outside via the insertion opening 3, thereby suppressing an ejection failure. Even if the ejection direction setting value 122*c* designates the direction toward the cut-sheet ejection opening 4 as an ejection direction for the cut sheet S, the print device 1 ejects the cut sheet S via the insertion opening 3 when the length L5 of the cut sheet S is insufficient. However, if the ejection direction fixing flag 122*d* indicates that the ejection direction is fixed, the print device 1 maintains the designated ejection direction, independently of the length L5 of the cut sheet S. In this case, even if the ejection direction setting value 122*c* designates the direction toward the cut-sheet ejection opening 4 as the ejection direction for the cut sheet S and the length L5 of the cut sheet S is insufficient, the print device 1 ejects the cut sheet S via the cut-sheet ejection opening 4.

If an excessively short length L1 of the cut sheet S is inserted into the print device 1, it may also fail to sufficiently protrude from the cut-sheet ejection opening 4. For example, when the length L5 of the cut sheet S calculated by the sheet length calculator 120*c* is shorter than the distance L2 between the driven roller 72 and the ejection position EJP, there are cases where the print controller 120*d* terminates the transport of the cut sheet S before the front end SA reaches the ejection position EJP. Even in such cases, the print device 1 successfully suppresses an ejection failure by ejecting the cut sheet S via the insertion opening 3 instead of the cut-sheet ejection opening 4. However, in general, the length of a cut sheet to be used in a printer such as the print device 1 is specified in advance, and a user of the print device 1 selects and uses, as the cut sheet S, a cut sheet conforming to this specification. Therefore, an insufficient length of the cut sheet S is rarely a cause of an ejection failure.

Figure 9:
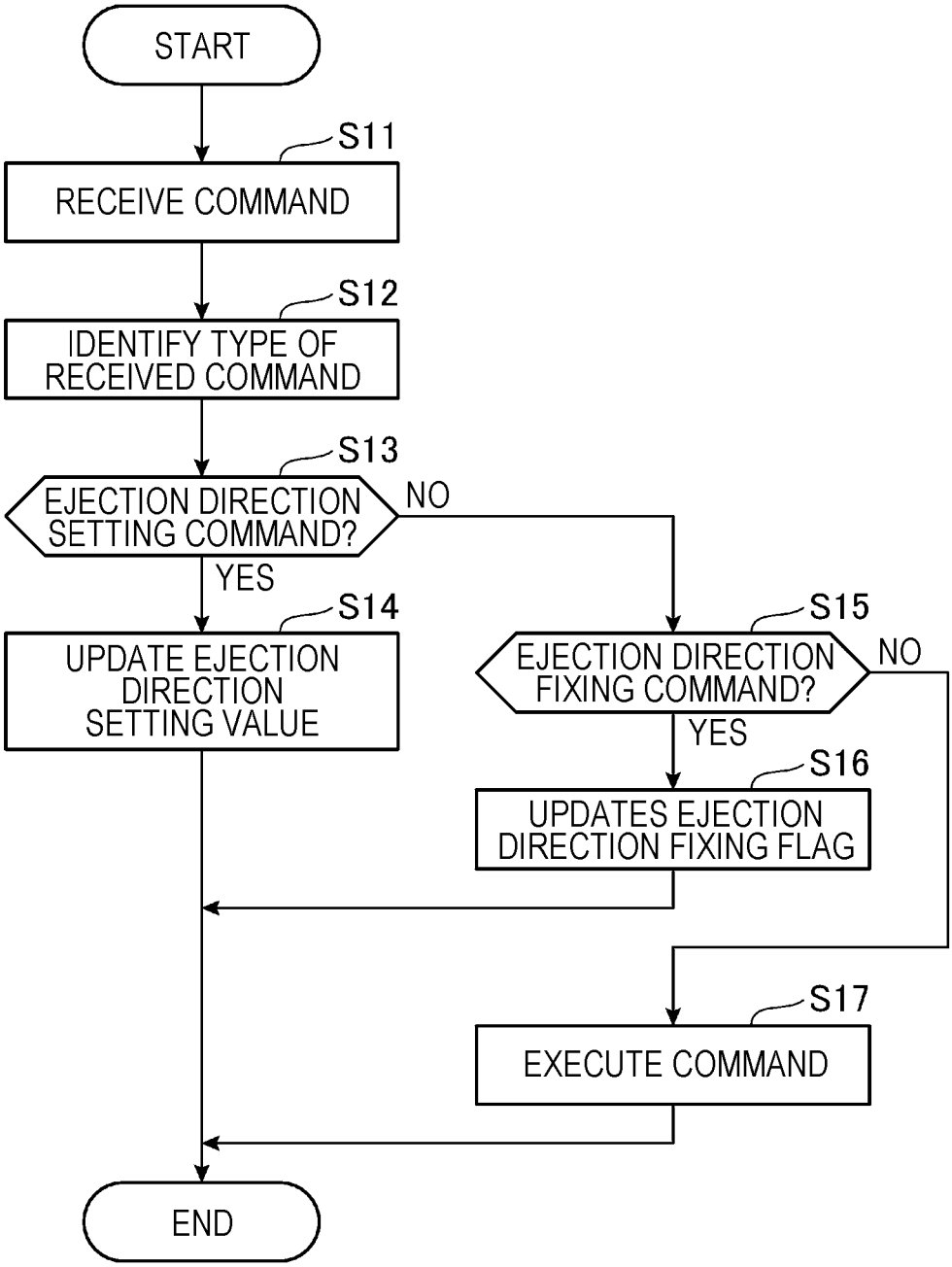
FIG. 9 is a flowchart of the operation of the print device.

FIG. 9 is a flowchart of an operation performed by the print device 1, especially when the print device 1 processes commands received through the communication I/F 123. At Step S11, the communication controller 120*a* receives a command through the communication I/F 123. At Step S12, the communication controller 120*a* stores the received command in the reception buffer 124 and then identifies which type the command belongs to. At Step S13, the communication controller 120*a* determines whether the command is the ejection direction setting command C2. When the command is determined to be the ejection direction setting command C2 (YES at Step S13), at Step S14, the setting section 120*e* updates the ejection direction setting value 122*c* in accordance with the ejection direction setting command C2, after which the controller 100 concludes this process.

When the command is determined not to be the ejection direction setting command C2 (NO at Step S13), at Step S15, the communication controller 120*a* determines whether the command is the ejection direction fixing command C3. When the command is determined to be the ejection direction fixing command C3 (YES at Step S15), at Step S16, the setting section 120*e* updates the ejection direction fixing flag 122*d* in accordance with the ejection direction fixing command C3, after which the controller 100 concludes this process.

When the command is determined not to be the ejection direction fixing command C3 (NO at Step S15), at Step S17, the controller 100 executes the command. For example, when the command is the print command C1, the print controller 120*d* executes the print command C1.

Figure 10:
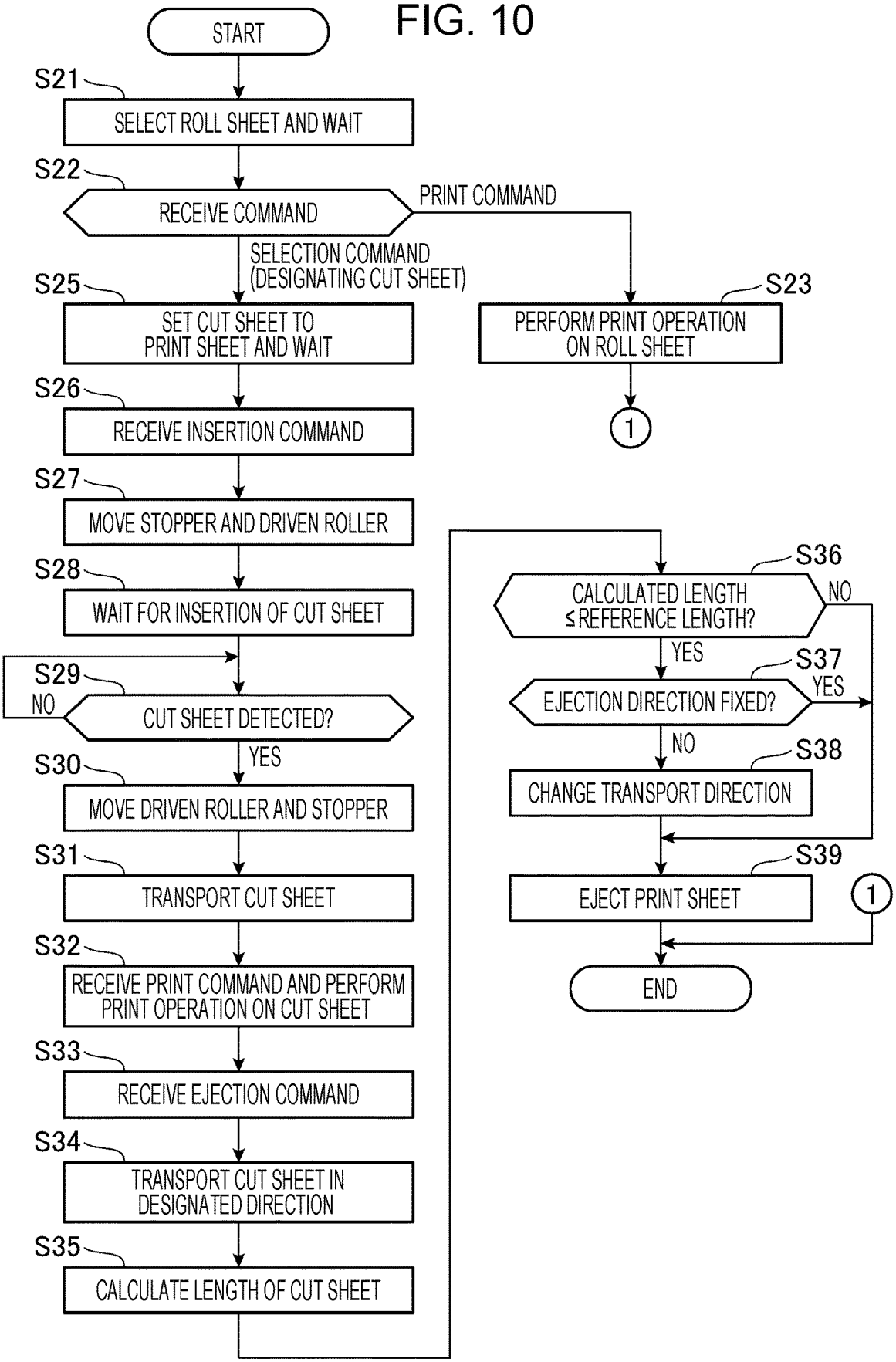
FIG. 10 is another flowchart of the operation of the print device.

FIG. 10 is a flowchart of the print operation performed by the print device 1 in accordance with the print command C1.

Before performing this process, the controller 100 has selected one of the roll sheet R and the cut sheet S in accordance with a selection command. In this embodiment, the controller 100 has selected the roll sheet R and is waiting for a command at Step S21. At Step S22, the communication controller 120*a* receives a command from the host computer 200. When the received command is determined to be the print command C1, at Step S23, the print head 22 performs the print operation on the roll sheet R. More specifically, the transport controller 120*b* drives the roll sheet transport motor 144 to transport the roll sheet R. Then, the print controller 120*d* causes the head driver circuit 126 to perform the print operation on the roll sheet R. After the print operation, the transport controller 120*b* ejects the roll sheet R to the outside via the roll-sheet ejection opening 8, after which the controller 100 concludes the process.

When the communication controller 120*a* receives a selection command that designates the cut sheet S from the host computer 200, at Step S25, the print device 1 changes the print sheet from the roll sheet R to the cut sheet S and then waits for another command. At Step S26, the communication controller 120*a* receives an insertion command, and then the print device 1 performs an operation for transiting to a waiting mode for the insertion of the cut sheet S. At Step S27, if the stopper 75 is not positioned on the transport route 5, the stopper moving section 76 moves the stopper 75 to the transport route 5. If the driven roller 72 is positioned on the driven roller 72, the roller moving section 73 moves the driven roller 72 away from the driven roller 72. At Step S28, the print device 1 waits for the insertion of the cut sheet S. In this case, the print device 1 allows the cut sheet S to be inserted via insertion opening 3 until the TOF sensor 131 detects that the front end SA makes contact with the stopper 75.

At Step S29, the transport controller 120*b* acquires the detection states from the BOF sensor 130 and the TOF sensor 131 and determines whether one or both of the BOF sensor 130 and the TOF sensor 131 detect the presence of the cut sheet S. If neither the BOF sensor 130 nor the TOF sensor 131 is determined to detect the presence of the cut sheet S (NO at Step S29), the print controller 120*d* waits until the cut sheet S is detected at Step S29.

At Step S29, the print controller 120*d* may determine whether one or both of the BOF sensor 130 and the TOF sensor 131 detects the presence of the cut sheet S during a preset period and, if the cut sheet S is not detected over the period, may return to the state in which the roll sheet R has been selected.

The user inserts the cut sheet S and then the front end SA makes contact with the stopper 75 and positioned in place, both the BOF sensor 130 and the TOF sensor 131 detect the presence of the cut sheet S (YES at Step S29). In response, the print device 1 makes the process proceed to Step S30. At Step S30, the transport controller 120*b* drives the roller moving section 73 to move the driven roller 72 to the transport route 5, and then the cut sheet S is interposed and held between the transport roller 71 and the driven roller 72. Simultaneously, the transport controller 120*b* drives the stopper moving section 76 to move the stopper 75 away from the transport route 5, so that the cut sheet S is transported.

At step S31, the transport controller 120*b* drives the cut sheet transport motor 143 such that both the transport roller 71 and the driven roller 72 transport the cut sheet S to a position (print start position) at which the print head 22 can perform the print operation. At Step S32, when the communication controller 120*a* receives the print command, the print controller 120*d* causes the head driver circuit 126 to drive the print head 22, thereby performing the print operation on the cut sheet S.

At Step S33, the communication controller 120*a* receives a command of ejecting the cut sheet S. At Step S34, the transport controller 120*b* resumes transporting the cut sheet S. More specifically, the transport controller 120*b* transports the cut sheet S in the direction designated by the ejection direction setting command C2. For example, when the ejection direction setting value 122*c* indicates that the ejection direction is the direction toward the cut-sheet ejection opening 4, the transport controller 120*b* drives the cut sheet transport motor 143 to transport the cut sheet S in the direction toward the cut-sheet ejection opening 4.

After the cut sheet S is transported at Step S34, the transport controller 120*b* monitors the detection state of the BOF sensor 130. As described above, the distance L10 between the BOF sensor 130 and the position at which transport roller 71 is in contact with the driven roller 72 has been stored in the flash ROM 122 in advance. When the BOF sensor 130 detects the absence of the cut sheet S, the transport controller 120*b* drives the cut sheet transport motor 143 to transport the cut sheet S by an amount equivalent to the distance L10. As a result, the rear end SB of the cut sheet S released from the interposition between both the transport roller 71 and the driven roller 72, and thus the user can take out the cut sheet S. Then, at Step S35, the sheet length calculator 120*c* calculates a length of the cut sheet S, based on the distance L10 and a transport amount FL, which is an amount in which the cut sheet S is transported over a period between when the cut sheet S is positioned, namely, when both the TOF sensor 131 and the BOF sensor 130 detect the presence of the cut sheet S and when the BOF sensor 130 detects the absence of the cut sheet S. More specifically, the sheet length calculator 120*c* may determine the length of the cut sheet S from the sum of the distance L10 and the transport amount FL. As described above, when the cut sheet S is in an inclined position, the BOF sensor 130 stops the absence of the cut sheet S earlier than when it is in a straight position. In which case, the sheet length calculator 120*c* determines that the length of the cut sheet S is shorter than an actual one. At Step S35, the sheet length calculator 120*c* stores the sheet length data 122*e* containing the calculated length in the RAM 121 or the flash ROM 122.

The detection of the length of the cut sheet S at Step S35 is made when the BOF sensor 130 detects the absence of the cut sheet S that has been transported at Step S31. Therefore, the detection may be made before or in the course of the print operation on the print head 22. In addition, the communication controller 120*a* does not necessarily have to receive the print command C1 after Step S29. Alternatively, the communication controller 120*a* may receive the print command C1 before both the BOF sensor 130 and the TOF sensor 131 detect the cut sheet S. In this case, the print operation based on the print command C1 may start at Step S32.

At Step S36, the print controller 120*d* determines whether the length of the cut sheet S contained in the sheet length data 122*e* is shorter than or equal to a predetermined reference length. The reference length is used to determine whether to eject the cut sheet S via the cut-sheet ejection opening 4. This reference length may be determined as appropriate in accordance with specifications and configuration of the print device 1. For example, the reference length may be determined based on the distance L2 between the driven roller 72 and the ejection position EJP. The reference length determined in this manner may be contained in the sheet length data 122*e*, which is stored in the flash ROM 122 in advance.

When the length contained in the sheet length data 122*e* is shorter than or equal to the reference length (YES at Step S36), at Step S37, the print controller 120*d* determines whether the ejection direction fixing flag indicates that the ejection direction is fixed. When the ejection direction fixing flag indicates that the ejection direction is changeable (NO at Step S37), at Step S38, the print controller 120*d* changes the ejection direction to the direction toward the insertion opening 3. Then, the controller 100 makes the process proceed to Step S39. When the ejection direction fixing flag indicates that the ejection direction is fixed (YES at Step S37), the print controller 120*d* maintains the ejection direction, and then the controller 100 makes the process proceed to Step S39. When the length contained in the sheet length data 122*e* is longer than the reference length (NO at Step S36), the print controller 120*d* maintains the direction toward the cut-sheet ejection opening 4 as the ejection direction. Then, the controller 100 makes the process proceed to Step S39.

At Step S39, the print controller 120*d* performs the print operation, after which the transport controller 120*b* transports the cut sheet S either in the direction toward the cut-sheet ejection opening 4 or in the direction toward the insertion opening 3 that has been set at Step S38. Then, the transport controller 120*b* ejects the cut sheet S via either the cut-sheet ejection opening 4 or the insertion opening 3. When the cut sheet S is ejected, the front end SA or rear end SB of the cut sheet S is released from the interposition between both the transport roller 71 and the driven roller 72. As a result, the user can take out the cut sheet S.

The controller 100 waits until the cut sheet S is taken out at Step S39. After the cut sheet S is taken out, both the TOF sensor 131 and the BOF sensor 130 detect the absence of the cut sheet S. The controller 100 sets the roll sheet R to the print medium. In this case, the controller 100 may determine that the cut sheet S is taken out when the TOF sensor 131 switches to the non-detection state, and then may execute the next print command C1.

As described above, a print device 1 according to one embodiment includes: a communication I/F 123 through which the print device 1 communicates with a host computer 200; an insertion opening 3 via which a cut sheet S is to be inserted or ejected; and a cut-sheet ejection opening 4 via which the cut sheet S is to be ejected. The print device 1 further includes a transport roller 71 and a driven roller 72, both of which serve as a transport section that transports the cut sheet S inserted via the insertion opening 3 along a transport route 5 formed between the insertion opening 3 and the cut-sheet ejection opening 4. The print device 1 further includes: a guide surface 3*a* that guides the cut sheet S on its first side in a direction orthogonal to a transport direction of the cut sheet S; and a case 2 that has a recess on a second side, the second side being opposite to the above first side, and contains the transport route 5. The print device 1 further includes: a print head 22 that performs a print operation on the cut sheet S; and a stopper 75 that is movable to/from the transport route 5 and stops, at a predetermined position, a front end SA of the cut sheet S inserted via the insertion opening 3. The print device 1 further includes: a TOF sensor 131 that is disposed upstream of the stopper 75 on the transport route 5 and detects presence of the cut sheet S; and a BOF sensor 130 that is positioned upstream of the TOF sensor 131 and detects the presence of the cut sheet S on the transport route 5 and adjacent to the guide surface 3*a*. The print device 1 further includes a controller 100 that controls the transport section, based on detection states of the TOF sensor 131 and the BOF sensor 130. When an ejection direction setting command C2 that has been received through the communication I/F 123 designates a direction toward the cut-sheet ejection opening 4 as an ejection direction for the cut sheet S and a length of the cut sheet S which is determined from the detection states of the TOF sensor 131 and the BOF sensor 130 is shorter than or equal to a predetermined length, the controller 100 ejects the cut sheet S via the insertion opening 3. The predetermined length is preset based on a distance between the transport section and the cut-sheet ejection opening 4.

The print device 1, which corresponds to a print device according to an aspect of the invention and employs a method of controlling this print device, may eject the cut sheet S to the outside via the insertion opening 3 even when the ejection direction setting command C2 designates the print device 1 to eject the cut sheet S inserted via the insertion opening 3 to the outside via the cut-sheet ejection opening 4. More specifically, when the length of the cut sheet S determined from the detection states of the BOF sensor 130 and the TOF sensor 131 is shorter than or equal to the predetermined length (reference length), the print device 1 ejects the cut sheet S to the outside via the insertion opening 3. In this way, even if the length of the cut sheet S is insufficient, the print device 1 ejects the cut sheet S to the outside. Therefore, the print device 1 can suppress a failure to eject the cut sheet S to the outside without being restricted by settings regarding an operation of ejecting the cut sheet S.

In the print device 1, the TOF sensor 131 may be misaligned from the BOF sensor 130 in the transport direction of the cut sheet S. This configuration enables the print device 1 to suppress a failure to eject the cut sheet S to the outside even if the length of the cut sheet S that would be in an inclined position is determined to be shorter than its actual length.

In the print device 1, the controller 100 may calculate the length of the cut sheet S, based on an amount in which the cut sheet S is transported over a period between when the front end SA of the cut sheet S makes contact with the stopper 75 and when the BOF sensor 130 detects absence of a rear end SB of the cut sheet S. This configuration can calculate the length of the cut sheet S in a simple manner using the stopper 75. Consequently, the print device 1 can suppress a failure to eject the cut sheet S to the outside even if the length of the cut sheet S that would be in an inclined position is determined to be shorter than its actual length.

The print device 1 may eject the cut sheet S via the insertion opening 3 when the length of the cut sheet S is shorter than or equal to the predetermined length, which is the distance between the cut-sheet ejection opening 4 and the transport section having a preset reference length. This configuration, if it is difficult to transport the cut sheet S to the cut-sheet ejection opening 4, changes from the cut-sheet ejection opening 4 to the insertion opening 3 as an opening via which the cut sheet S is to be ejected. Consequently, the print device 1 can suppress a failure to eject the cut sheet S to the outside without being restricted by settings regarding an operation of ejecting the cut sheet S.

The print device 1 may transport the cut sheet S, based on the length of the cut sheet S when ejecting the cut sheet S to the outside via the cut-sheet ejection opening 4. More specifically, the print device 1 may transport the cut sheet S until the front end SA of the cut sheet S protrudes from the cut-sheet ejection opening 4. As illustrated in FIG. 6, for example, the print device 1 may transport the cut sheet S until the front end SA of the cut sheet S protrudes from an ejection position EJP by a length L3. This configuration can transport the cut sheet S to a position where a user can easily take out the cut sheet S. If the cut sheet S does not have an enough length to be transported to the above position, the print device 1 changes ejection openings for the cut sheet S. In this way, the print device 1 can suppress a failure to eject the cut sheet S to the outside.

The print device 1 may further include a transport roller 91 and a driven roller 92, both of which serve as a roll sheet transport section that transports the roll sheet R along a roll sheet transport route. This roll sheet transport route may overlap the transport route 5. In the print device 1, the controller 100 may perform a print operation on the roll sheet R with the print head 22 when the TOF sensor 131 detects the absence of the cut sheet S. As described in the embodiment, for example, when the roll sheet R is selected as a print medium, the print device 1 may perform the print operation on the roll sheet R in response to the reception of a print command. In short, the controller 100 may perform the print operation on the roll sheet R when the TOF sensor 131 detects absence of the cut sheet S. Consequently, the print device 1, which is designed to perform the print operation on both the roll sheet R and the cut sheet S inserted via the insertion opening 3, can suppress a failure to eject the cut sheet S to the outside even if an inclined position of the cut sheet S inhibits accurate determination of the length of the cut sheet S.

In the print device 1, even if the length of the cut sheet S determined from the detection states of the TOF sensor 131 and the BOF sensor 130 is shorter than or equal to the reference length, the controller 100 may eject the cut sheet S to the outside via the cut-sheet ejection opening 4 in response to an ejection direction fixing command C3 received through the communication I/F 123. In this way, the print device 1 can suppress a failure to eject the cut sheet S to the outside and can fixedly set an ejection direction for the cut sheet S in response to commands. Consequently, the print device 1 allows an operation of ejecting the cut sheet S to be set in detail through commands from the host computer 200.

The embodiment of the invention has been described; however, the invention is not limited to this embodiment. For example, the transport route 5 in the print device 1 may have a linear shape; the print head 22 may employ any given printing method; and any given number of transport rollers may be used to transport the cut sheet S. In addition to the guide surface 3*a* provided on one side of the transport route 5, another guide surface may be provided on the other side of the transport route 5. This configuration also enables the print device 1 to reliably eject the cut sheet S to the outside even if the cut sheet S is in an inclined position. For example, programs that the controller 100 in the print device 1 reads and executes to perform the above operation may be stored in a storage medium in the print device 1 or an external device. One or more of the functional blocks of the foregoing embodiment, illustrated in the block diagram in FIGS. 3 and 4, may be implemented either in hardware or in a combination of hardware and software. Thus, the functional blocks in the block diagram do not necessarily have to be implemented using respective independent hardware resources. The programs to be executed by the controller 100 may be stored in a storage section inside the print device 1 or an unillustrated independent storage device. The controller 100 may acquire the programs from an external device and execute them. Detailed configurations of the other sections in the print device 1 may also undergo any modifications without departing the spirit of the invention.

What is claimed is:

1. A print device comprising:

a transport route along which a print medium is transported in a transport direction;

a first opening via which the print medium is inserted or ejected at a first end of the transport route in the transport direction;

a second opening via which the print medium is ejected at a second end of the transport route in the transport direction;

a transport roller configured to transport the print medium inserted via the first opening, the transport roller being provided on the transport route of the print medium;

a housing configured to guide the print medium on its one side in a direction orthogonal to the transport direction;

a head configured to perform a print operation on the print medium based on a print command;

a stopper configured to stop, at a preset position, a front end of the print medium inserted via the first opening by closing the transport route;

a first sensor configured to detect presence of the print medium, the first sensor being provided upstream of the stopper on the transport route;

a second sensor configured to detect the presence of the print medium, the second sensor being provided upstream of the first sensor on the transport route; and a processor configured to:

receive a first command which designates one of an ejection direction toward the first opening and an ejection direction toward the second opening;

control the transport roller to eject the print medium printed by the head via the first opening if the ejection direction toward the first opening is designated by the first command and when a length of the print medium based on detection states of the first sensor and the second sensor is longer than a predetermined length based on a distance between the transport roller and the second opening;

control the transport roller to eject the print medium printed by the head via the second opening if the ejection direction toward the second opening is designated by the first command and when the length of the print medium based on the detection states of the first sensor and the second sensor is longer than the predetermined length; and control the transport roller to eject the print medium via the first opening if the ejection direction toward the second opening is designated by the first command and when the length of the print medium based on the detection states of the first sensor and the second sensor is shorter than or equal to the predetermined length.

2. The print device according to claim 1, wherein the first sensor is misaligned from the second sensor in the transport direction.

3. The print device according to claim 2, wherein the processor is further configured to calculate the length of the print medium, based on an amount in which the print medium is transported over a period between when the front end of the print medium makes contact with the stopper and when the second sensor detects absence of a rear end of the print medium.

4. The print device according to claim 1, wherein when ejecting the print medium via the second opening, the processor is further configured to transport the print medium based on the length of the print medium until the front end of the print medium protrudes from the second opening.

5. The print device according to claim 1, further comprising a roll sheet transport route along which a roll sheet is transported, the roll sheet transport route overlapping the transport route, wherein the processor is further configured to control the head to perform the print operation on the roll sheet when the first sensor detects absence of the print medium.

6. The print device according to claim 1, wherein even when the length of the print medium based on the detection states of the first sensor and the second sensor is shorter than or equal to the predetermined length, the processor is further configured to control the transport roller to eject the print medium via the second opening designated by the first command, in response to a second command received from an external device.

7. A method of controlling a print device, the print device including a transport route along which a print medium is transported in a transport direction, a first opening via which the print medium is inserted or ejected at a first end of the transport route in the transport direction, a second opening via which the print medium is ejected at a second end of the transport route in the transport direction, a transport roller configured to transport the print medium inserted via the first opening, the transport roller being provided on the transport route, a housing configured to guide the print medium on its one side in a direction orthogonal to the transport direction of the print medium, a head configured to perform a print operation on the print medium based on a print command, and a stopper configured to stop, at a preset position, a front end of the print medium inserted via the first opening by closing the transport route, the method comprising:

receiving a first command which designates one of an ejection direction toward the first opening and an ejection direction toward the second opening;

ejecting the print medium printed by the head via the first opening if the ejection direction toward the first opening is designated by the first command and when a length of the print medium based on detection states of a first sensor and a second sensor is longer than a predetermined length based on a distance between the transport roller and the second opening;

ejecting the print medium printed by the head via the second opening if the ejection direction toward the second opening is designated by the first command and when the length of the print medium based on the detection states of the first sensor and the second sensor is longer than the predetermined length; and ejecting the print medium via the first opening if the ejection direction toward the second opening is designated by the first command and when the length of the print medium based on the detection states of the first sensor and the second sensor is shorter than or equal to the predetermined length, wherein the first sensor is configured to detect presence of the print medium, the first sensor being provided upstream of the stopper on the transport route, and wherein the second sensor is configured to detect the presence of the print medium, the second sensor being provided upstream of the first sensor on the transport route.

* * * * *